US005139172A

United States Patent [19]

Brown

[11] Patent Number: 5,139,172

[45] Date of Patent: Aug. 18, 1992

[54] BOTTOM DISCHARGE DISPENSER WITH FLOW CONTROL FOR FLUENT LAUNDRY PRODUCTS AND THE LIKE

[76] Inventor: Terry Brown, 806 West 11th, Stuttgart, Ark. 72160

[21] Appl. No.: 789,950

[22] Filed: Nov. 12, 1991

[51] Int. Cl.[5] ..... B67D 5/06

[52] U.S. Cl. ..... 222/181; 222/481.5; 222/554

[58] Field of Search ..... 222/181, 185, 545, 481.5, 222/548, 554, 555

[56] References Cited

U.S. PATENT DOCUMENTS

| | | | |
|---|---|---|---|
| Re. 33,083 | 10/1989 | Pellegrino | 222/181 |
| 2,293,476 | 8/1942 | Snellings | 222/554 X |
| 3,078,016 | 2/1963 | Judy | 222/181 |
| 3,148,695 | 9/1964 | Groen, Jr. et al. | 222/554 X |
| 4,448,331 | 5/1984 | Millette et al. | 222/181 |
| 4,505,407 | 3/1985 | Johnson | 222/181 |

FOREIGN PATENT DOCUMENTS

| | | | |
|---|---|---|---|
| 164680 | 5/1949 | Fed. Rep. of Germany | 222/181 |
| 8301201 | 11/1984 | Netherlands | 222/181 |
| 767349 | 1/1957 | United Kingdom | 222/181 |

OTHER PUBLICATIONS

"Heinz adopts new ketchup pack", *Packaging Trends*; pp. 10–11, Feb., 1983.

*Primary Examiner*—Gregory L. Huson
*Attorney, Agent, or Firm*—Ray F. Cox, Jr.

[57] ABSTRACT

A wall-mounted container capable of storing in bulk both liquid and powdered forms of standard laundry products, such as detergents, bleaches and fabric softeners. The container has a wide opening at the top for receiving fluid laundry products. The top may be closed with a tight fitting lid which may also serve as a stand to support a cup for receiving the dispensed products. The bottom of the container is a funnel shape to allow the fluid contents to flow downwards into a valve located at the apex of the funnel. A standard ball valve with a wide aperture is capable of passing both liquid and powdered materials while preventing any leakage when closed.

2 Claims, 4 Drawing Sheets

BOTTOM DISCHARGE DISPENSER WITH FLOW CONTROL FOR FLUENT LAUNDRY PRODUCTS AND THE LIKE

BACKGROUND OF THE INVENTION

1. Field of the Invention

The present invention relates to containers for storing and dispensing fluid materials and more particularly to containers for storing and dispensing both liquid and powdered forms of laundry products, such as detergents, bleaches or fabric softeners.

2. Description of the Prior Art

The modern residential laundry room is normally home to numerous containers for various types of laundry products. One would expect to find both liquid and dry detergents, bleaches and fabric softeners. These various laundry products are normally stored and dispensed from the containers in which they are originally packaged. The containers may be of cardboard or plastic and may contain various techniques for dispensing the products. Some of the containers may provide for being reclosed or resealed while others once opened cannot be resealed.

These containers suffer from a number of problems and inconveniences related to efficient and economical use. For example, containers that cannot be resealed are subject to being knocked over with subsequent loss of the product. This is both uneconomical and an unnecessary clean-up chore. Furthermore, most containers for laundry products provide no integral method for easily and conveniently measuring or dispensing the product. Most often the containers must be opened and inverted so that the product flows out into a measuring container. Spills and inaccurate measurements are commonplace.

In addition, laundry product containers are available in varying sizes. The larger sizes are generally the most economical, however, the larger sizes are also the most difficult to dispense from in practice.

There is therefore a need for means by which laundry products may be conveniently and neatly stored and dispensed. The present invention satisfies this need by providing for wall mounted storage containers having means for dispensing fluid materials, both liquid and powder, from the bottom of the container. These containers may be easily refilled from any of the standard product containers. Furthermore, the present invention may be sealed to prevent contamination. In addition, the design of the present invention allows for clean and easily controlled dispensing of laundry products.

Various types of containers for the bottom delivery of fluid materials are known in the art. For example, U.S. Pat. No. 4,969,581 issued to Seifert, et al. on Nov. 13, 1990 discloses a bottom delivery package with a self-sealing valve for storing and dispensing a fluid material. This package, however, is not intended for reuse. Furthermore, the package is not intended for bulk storage of laundry products. Likewise, U.S. Pat. No. 4,120,420 issued to Dirksing on Oct. 17, 1978 discloses a dispensing package for flowable material but is not intended for reuse. U.S. Pat. No. 4,099,654 issued to Antolino on Jul. 11, 1978 discloses a graduated measuring cup having a bottom discharge. Antolino, however, is not adapted to the storage and disposal of bulk laundry products.

Accordingly, it is an object of the present invention to provide for a storage and dispensing container for fluid material and, in particular, for laundry products.

More specifically it is an object of the present invention to provide such a storage and dispensing container which can store bulk quantities of both liquid and powdered laundry products, which may be easily filled and resealed to prevent contamination of the laundry products, which provides for controlled dispensing through a valved bottom delivery system, and which carries out the aforementioned objects in an economical manner.

SUMMARY OF THE INVENTION

The present invention provides for a wall mounted container capable of storing in bulk both liquid and powdered forms of standard laundry products such as detergents, bleaches and fabric softeners. The container has a wide opening at the top for receiving fluid laundry products. The top may be closed with a tight fitting lid. The bottom of the container is funnel shaped to allow the fluid contents to flow downwards into a valve located at the apex of the funnel. A standard ball valve with a wide aperture is capable of passing both liquid and powdered materials while preventing any leakage when closed.

For maximum flexibility and economical manufacturing, the present invention is provided with a close fitting lid that may be inverted and affixed in position below the valve to act as a support for a measuring cup or other container for receiving the laundry products dispensed from the present invention.

Multiples of the present invention may be mounted side-by-side so that various types of laundry products may be available. For ease in mounting the devices side-by-side, tabs are provided that nest together to provide for both a structurally strong mounting system and a self-aligning configuration for good aesthetics.

BRIEF DESCRIPTION OF THE DRAWINGS

In the accompanying drawings in which are shown the preferred embodiment of the invention.

DESCRIPTION OF THE PREFERRED EMBODIMENT

Figure 1:
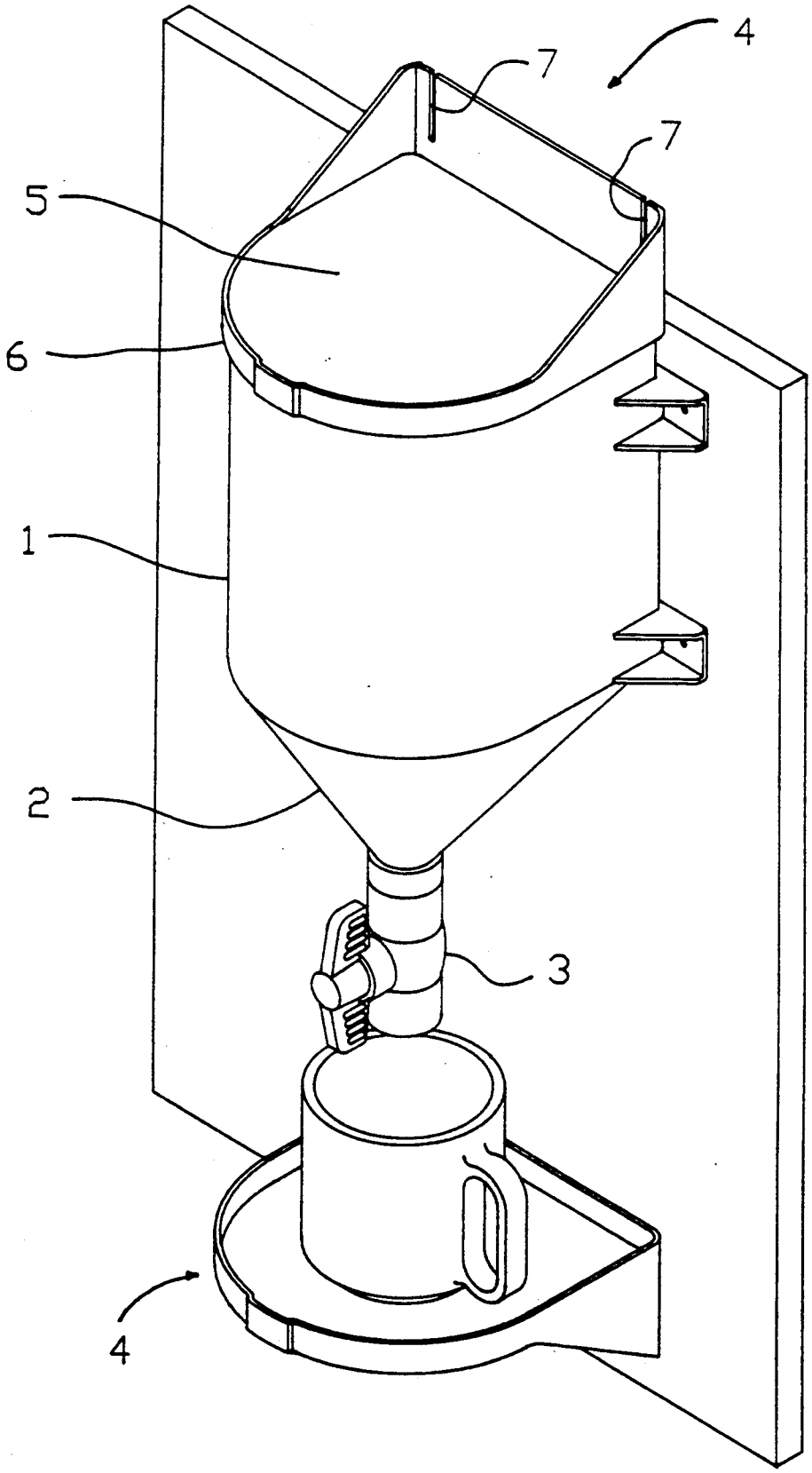
FIG. 1 is a perspective view of the dispensing container in a wall mounted configuration

The preferred embodiment of the present invention may be described with reference to FIG. 1. A hopper section 1 with substantially vertical sides is mated to a funnel section 2. The narrow end of the funnel section 2 receives a ball valve 3. A lid 4 shields the hopper section 1 from contamination. The lid 4 may be removed for replenishing the contents of the dispenser. The lid 4 comprises a substantially horizontal plate 5 which is sized to cover the opening of the hopper section 1 and a rim 6 which extends downward from the plate 5 and extends around the edge of the hopper section 1 so as to provide a close fitting seal. The lid 4 is provided with a pair of slots 7 in the rear portion of the rim 6 which extends upward from the plate 5. The lid 4 may be turned upside down and by means of the slots 7 may be mounted to a surface directly beneath the outlet of the ball valve 3. When used in this configuration, the lid 4 acts as a shelf for supporting measuring cups or other containers to hold the laundry products dispensed from the invention.

Figure 2:
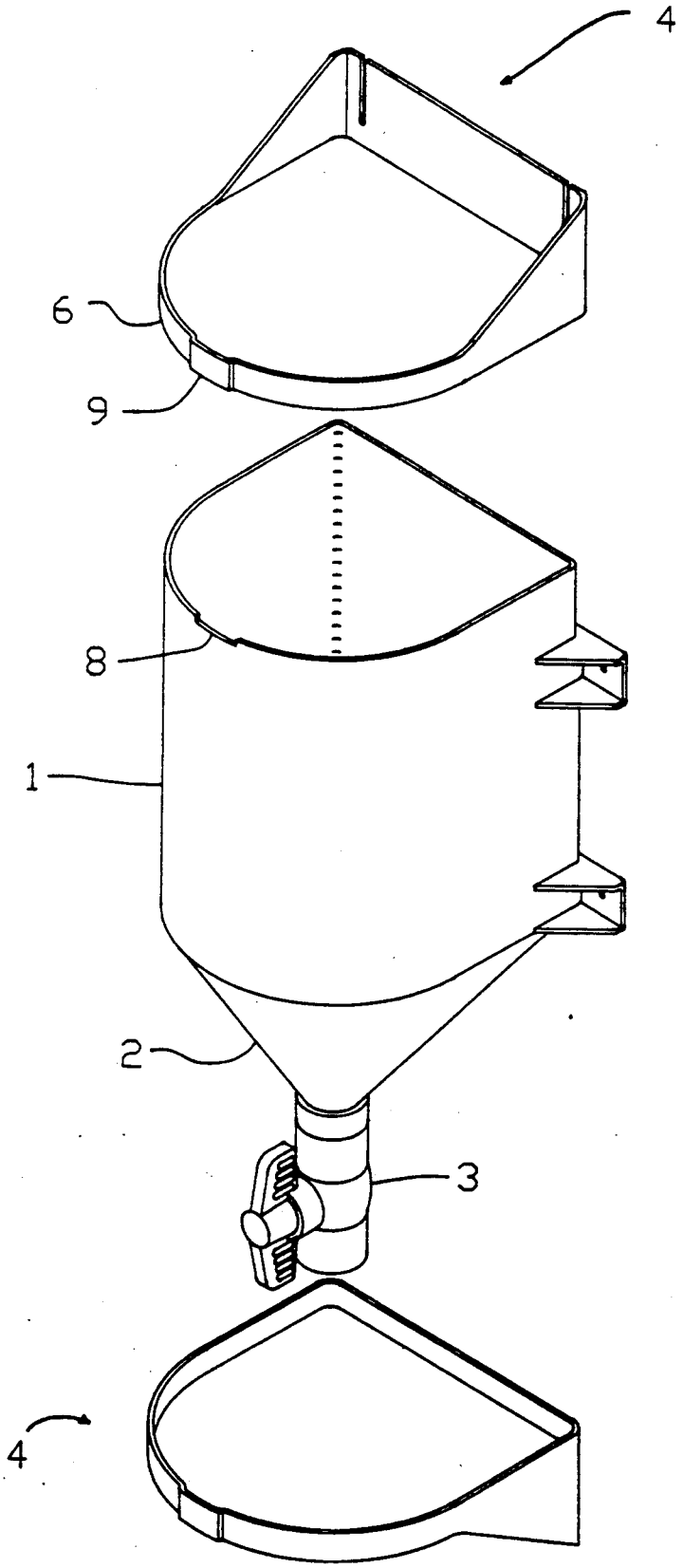
FIG. 2 is an exploded perspective view of the dispensing container showing the lid separated from the container.
Figure 3:
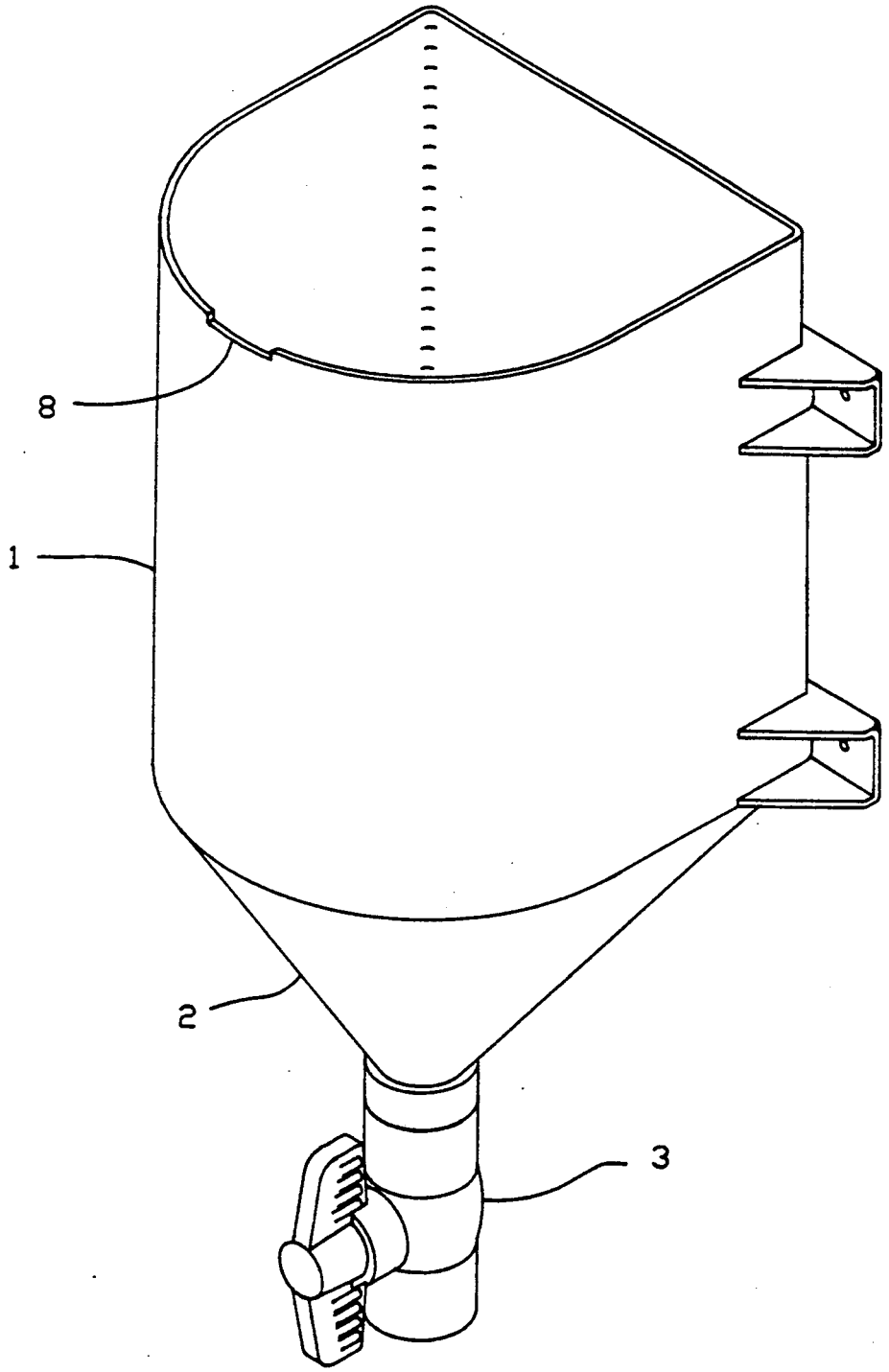
FIG. 3 is a perspective view of the dispensing container without the lid.

Although the lid 4 should fit tightly around the upper edge of the hopper section so as to prevent contamination of the contents, it is important that means be provided to introduce air into the dispenser so that the product may flow freely through the ball valve 3. If the lid 4 produced an airtight seal around the hopper section 1, the resultant production of a vacuum might prevent the smooth flow of product through the ball valve 3. The introduction of air is accomplished through a recessed portion 8 of the upper edge of the hopper section as may be seen with reference to FIG. 2. A protruded section 9 of the rim 6 of the lid 4 matches the recess 8 so as to allow the free flow of air into the invention while product is being dispensed.

Figure 4:
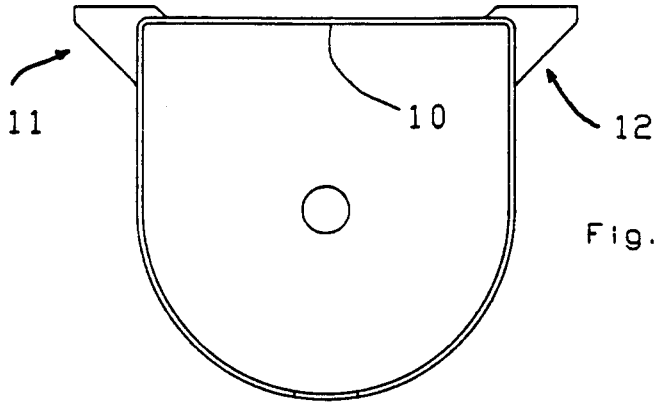
FIG. 4 is a plan view from the top of the container.
Figure 5:
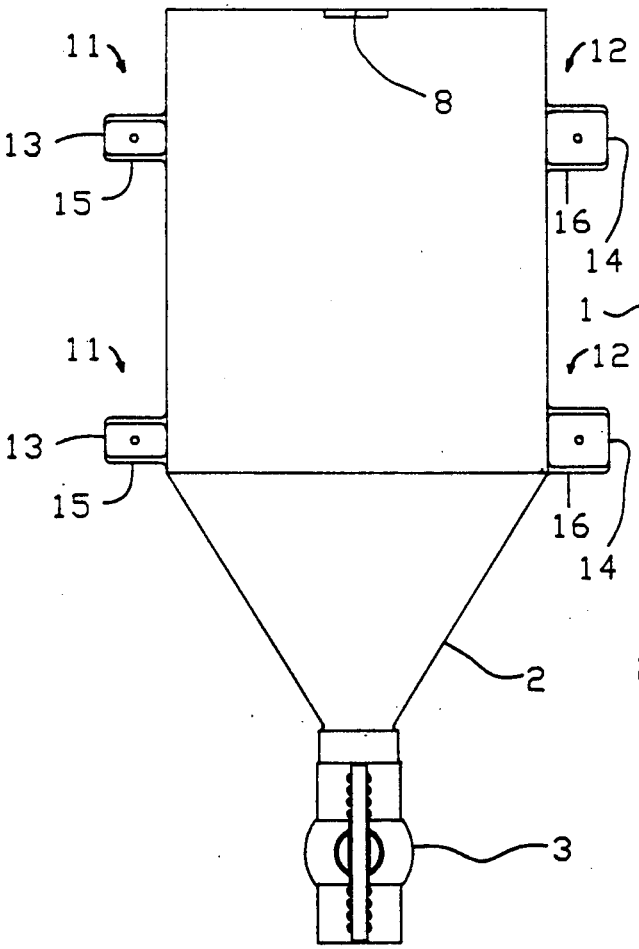
FIG. 5 is an elevation view of the front of the dispensing container.
Figure 6:
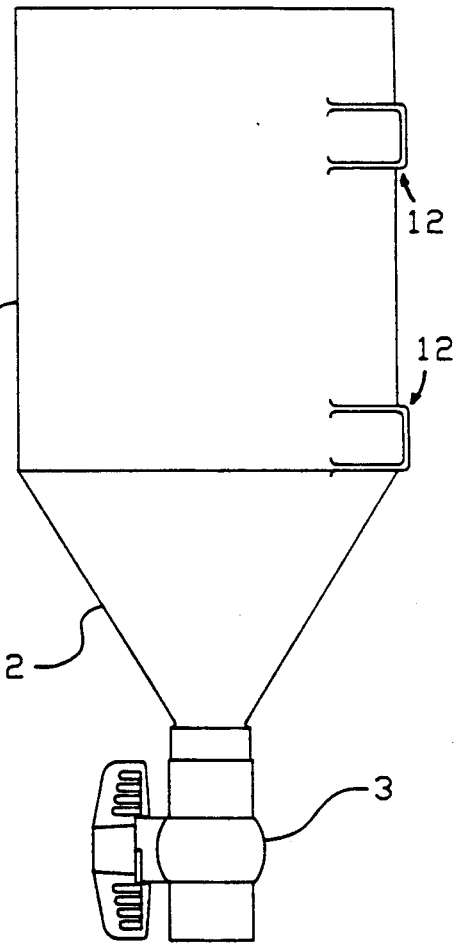
FIG. 6 is an elevation view of the side of the dispensing container.

In order to allow the lid 4 to fit completely around the upper rim of the hopper section 1, the entire dispenser must be mounted with a slight gap between its rear wall 10 and the surface upon which it is mounted. With reference to FIG. 4, it may be seen that the dispenser is provided with a pair of left mounting tabs 11 and a pair of right mounting tabs 12. The tabs 11 and 1 comprise mounting plates 13 and 14, respectively, and diagonal braces 15 and 16, respectively. The diagonal braces 15 and 16 extend rearward of the hopper section 1 such that the mounting plates 15 and 16 are parallel to but rearward of the rear wall 10 of the hopper section 1. Thus the necessary gap is produced.

A plurality of the dispensers may be mounted side-by-side. In order to insure that the plurality of dispensers are properly aligned and rigidly affixed one to another, the right mounting tabs 12 are wider in vertical dimension than the left mounting tabs 11. In mounting two dispensers side-by-side, the left mounting tabs 11 of the right-most dispenser would be placed within the right mounting tabs of the left-most dispenser, thus insuring perfect alignment and structural rigidity.

In actual use, the dispenser could be constructed of any number of materials, however, construction of the dispenser in clear plastic for easy visibility of the product would have certain obvious advantages.

The ball valve 3 may be attached to the funnel section 2 by any number of means that would be readily apparent to one skilled in the art. A permanent fastening of the ball valve 3 to the lower portion of the funnel section 2 would be one possibility. There are certain advantages, however, to threadedly mounting the ball valve 3 to the funnel section 2. A threaded mounting would allow for removal of the ball valve for cleaning.

Other modifications to the preferred embodiment of the present invention would be obvious to one skilled in the art. While the particular embodiment of the present invention has been shown and described above, modification may be made to the dispenser without departing from the scope of the invention as set forth in the appended claims.

What is claimed is:

1. A container for storing and dispensing laundry products, comprising:

a hopper section having substantially vertical sides and a wide top opening;

a funnel section mated to the bottom of said hopper section and tapering downwardly therefrom to a narrow bottom opening;

a ball valve affixed to said narrow bottom opening, said ball valve having an aperture of sufficient diameter to allow the free passage of fluid laundry products, both liquids and powders;

a plurality of mounting tabs affixed to the sides of said hopper section, each of said mounting tabs comprising a mounting plate having an opening therein for receiving a screw, bolt or similar mounting means, and a pair of diagonal braces, said diagonal braces being rigidly affixed to said hopper section and said mounting plate such that each of said mounting plates extend rearward of the rear wall of said hopper section, thereby forming a gap between said rear wall and the surface to which said container is mounted; and a removable lid for closing said wide top opening of said hopper section, said removable lid having means for introducing air into said hopper section while dispensing laundry products; said removable lid further comprising a substantially horizontal plate sized to fit said wide top opening of said hopper section;

a rim extending downwardly from said horizontal plate and fitting closely around the top edge of said hopper section;

said rim further extending upwardly from the rear of said horizontal plate and containing a plurality of vertical slots therein, such that said removable lid may be inverted and removably affixed to the surface to which said container is mounted so as to provide a shelf for supporting measuring cups or suchlike below the opening of said ball valve; and wherein said means for introducing air comprises a recessed portion of the upper edge of said hopper section; and a protruded section of said rim of said lid, said protruded section being located substantially adjacent to said recessed portion so as to allow the passage of air therebetween.

2. A container as set forth in claim 1 wherein said plurality of mounting tabs further comprises a pair of leftward mounting tabs and a pair of rightward mounting tabs, wherein said rightward mounting tabs are larger in vertical dimension than said leftward mounting tabs such that said leftward mounting tabs of one of a plurality of containers may nest within said rightward mounting tabs of another of said plurality of containers.

* * * * *